United States Patent [19]

Calabrese

[11] 4,372,247

[45] Feb. 8, 1983

[54] COLD PRESSURE FUSING APPARATUS

[75] Inventor: Richard A. Calabrese, Newtown, Conn.

[73] Assignee: Pitney Bowes Inc., Stamford, Conn.

[21] Appl. No.: 381,814

[22] Filed: Dec. 21, 1981

Related U.S. Application Data

[63] Continuation of Ser. No. 124,034, Feb. 25, 1980, abandoned.

[51] Int. Cl.[3] ..... B05C 1/08; G03G 15/20

[52] U.S. Cl. ..... 118/116; 29/130; 29/132; 100/93 RP; 100/160; 100/169; 100/176; 118/653; 156/555

[58] Field of Search ..... 156/555, 582, 579, 574; 100/93 RP, 155 R, 155 G, 160, 169, 176, 211; 29/130, 132, 110; 118/653, 114, 116, 117

[56] References Cited

U.S. PATENT DOCUMENTS

| | | | |
|---|---|---|---|
| 3,138,695 | 6/1964 | Bracich | 156/582 |
| 3,854,975 | 12/1974 | Brenneman et al. | 29/132 |
| 3,884,623 | 5/1975 | Slack | 100/93 RP |
| 3,945,723 | 3/1976 | Cook et al. | 29/130 |
| 3,988,817 | 11/1976 | Thettu | 29/130 |
| 4,001,544 | 1/1977 | Heinzek et al. | 100/93 RP |

*Primary Examiner*—Michael G. Wityshyn

*Attorney, Agent, or Firm*—Lawrence E. Sklar; William D. Soltow, Jr.; Albert W. Scribner

[57] ABSTRACT

Fusing apparatus for fixing toner material to a copy sheet. The apparatus comprises a pair of parallel, cold pressure fixing rollers, each of said rollers including a cylindrical metal tube open at both ends thereof, a cured elastomer occupying the volume enclosed by and bonded to said cylindrical tube, and a shaft extending through and bonded to said elastomer. The shaft is concentric with the tube. The apparatus also comprises means for applying a force to one of the two roller shafts to thereby apply a uniform pressure to the nip of the cold pressure fixing rollers.

5 Claims, 2 Drawing Figures

COLD PRESSURE FUSING APPARATUS

This is a continuation of application Ser. No. 124,034, filed Feb. 25, 1980, now abandoned.

BACKGROUND OF THE INVENTION

The instant invention relates to electrophotocopying machines, and more particularly to cold pressure fusing rollers used to fix toner material to copy sheets.

The process of copying indicia by the technique of forming an electroscopic powder on a surface of a substrate is well developed. Typically, this is accomplished in either of two ways. In either of these methods, a phtoconductive surface is electrically charged and then exposed to a light and shadow pattern of the image. The electrostatic charge which was deposited upon the photoconductive surface is removed from those places exposed to light, leaving a latent electrostatic image which can be developed. Development is accomplished by exposing the electrostatic image to a colored powder, usually referred to as a toner, having the property of being attracted to the electrostatic image areas. According to the first method, the toner is then fixed (permanently adhered) to the photoconductive surface (e.g. photosensitive copy paper). According to the other method, the toner image formed on the photoconductive layer is first transferred to another substrate, e.g., a sheet of ordinary paper, and is then fixed on that other substrate.

The toner is normally a blend of thermoplastic resin, carbon black or other pigment, and a small amount of dye. The exact composition depends upon the specific purpose for which it is to be used.

The fixing of the toner is normally accomplished by heat fusing the thermoplastic resin component thereof. This is usually performed by exposing the image to heat for a sufficient time to melt somewhat the toner particles so that they adhere, one to the other, and to the paper or substrate. Some fixing techniques have also employed the pressure developed by two hard surfaced rolls to fix the particles. Another process passes the substrate between hard surfaced rolls in combination with the application of heat.

Heat fusing, while producing effective results in many cases, is undesirable in that it requires that a supply of heat be available, usually entailing a supply of electric power in large quantities, and presents the possibility of overheating the substrate as well as the toner, with some danger of fire as a result. Pressure fixing as applied in the prior art has consisted of passing the toner substrate between two solid metal, hard surfaced rolls, one roll being movable by expensive spring assemblies to provide a controlled pressure. Experience has shown that obtaining uniform pressure with cold pressure fixing rollers is very difficult. Accordingly, several cold pressure fixing systems now employ rollers which are skewed (i.e. wrapped about each other) rather than parallel. However, skewed rollers present additional problems with regard to cleaning the rollers, creasing the copy paper, etc. The instant invention, therefore, overcomes the foregoing problems associated with obtaining uniform pressure with cold pressure fixing rollers by providing a pair of parallel rollers which require no springs, generate less noise, are easier to start and stop owing to less inertia to be overcome, and facilitate entry and exit of copy paper from the nip.

SUMMARY OF THE INVENTION

Accordingly, the instant invention provides fusing apparatus for fixing toner material to a copy sheet. The apparatus comprises a pair of parallel, cold pressure fixing rollers, each of the rollers having a cylindrical metal tube open at both ends thereof, a cured elastomer occupying the volume enclosed by and bonded to the cylindrical tube, and a shaft extending through and bonded to said elastomer. The apparatus further comprises means for applying a force to one of the two roller shafts to thereby apply a uniform pressure to the nip of the cold pressure fixing rollers.

DETAILED DESCRIPTION

Figure 1:
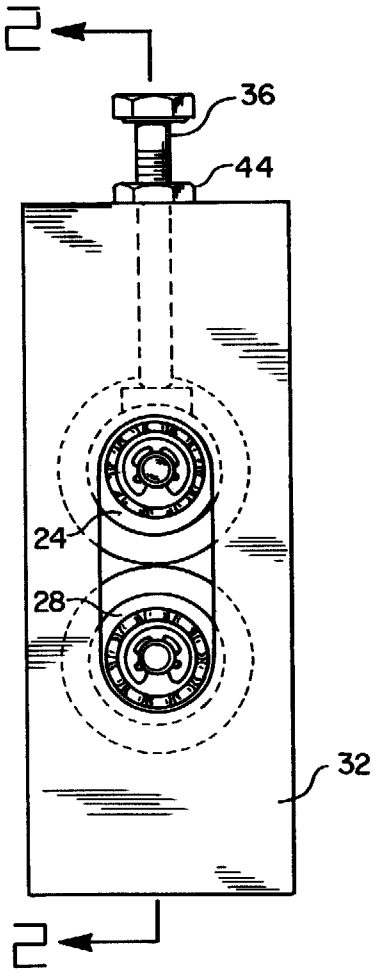
FIG. 1 is a side elevational view of a cold pressure fixing roller assembly for an electrophotocopier in accordance with the instant invention.
Figure 2:
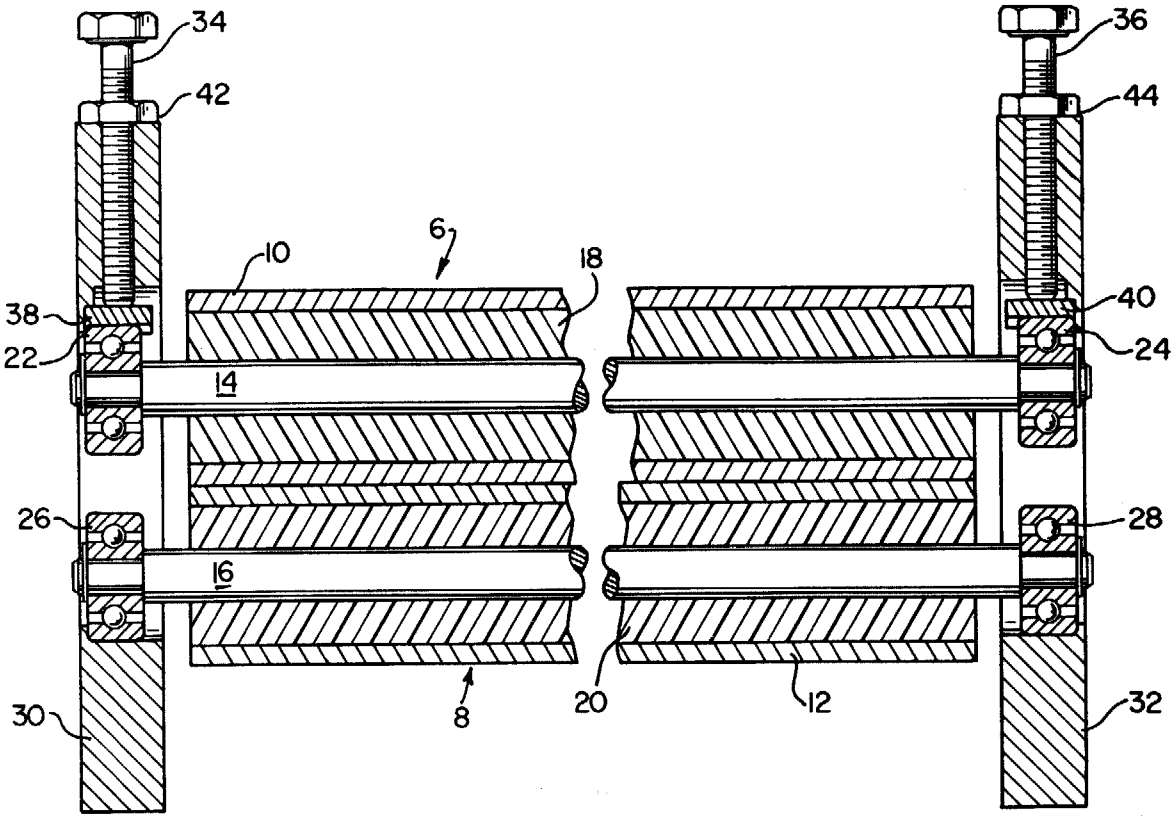
FIG. 2 is a sectional view taken on the vertical plane indicated by the line 2—2 in FIG. 1.

In describing the preferred embodiment of the instant invention, reference is made to the drawings, wherein there is seen a pair of parallel, cold pressure fixing rollers 6 and 8 comprising, respectively, steel tubes 10 and 12 open at both ends and mounted on shafts 14 and 16 respectively hereinafter described. The spaces between the tubes and the shafts are filled with cured elastomer cores 18 and 20. The shafts 14 and 16 are journalled in bearings 22 and 24, and 26 and 28 respectively. The bearings 22 and 26 are mounted in end support 30 while bearings 24 and 28 are mounted in end support 32. The end supports 30 and 32 in turn are secured to the photocopier housing (not shown). A pair of bolts 34 and 36 threadingly engage the end supports 30 and 32 respectively and seat on a pair of pressure transmitting wedges 38 and 40 respectively. Lock nuts 42 and 44 threadingly engage the bolts 34 and 36 respectively and tighten against the upper surfaces of the end supports 30 and 32 respectively.

In describing the preferred method of forming the rollers 6 and 8, reference will be made to the upper roller 6, it being understood that the lower roller 8 may be formed in exactly the same manner. The steel tube 10 provides a form and curing mold for the elastomer core 18 and temporary plates (not shown) are added to the ends of tube 10. The shaft 14 is set concentrically within the tube 10 and the elastomer core is then poured into the tube 10 and about the shaft 14. The assembly is then baked to cure the elastomer and form a bond between the elastomer and the tube 10 and between the elastomer and the shaft 14. In order to improve the bond between the elastomer and the shaft 14, the surface of the shaft 14 is knurled.

As the bolts 34 and 36 are tightened, pressure is applied to the nip of the fusing rollers 6 and 8 by deflection of the elastomer. This deflection is uniform, thereby providing uniform pressure across the lengths of the fusing rollers 6 and 8. The uniform deflection is effected by the elastomer which acts in the manner of hydraulic fluid to distribute any variations in the pressure. Rigidity of the roller surfaces is assured by the outer diameter and thickness of the tubes 10 and 12. One significant advantage achieved by the foregoing structure is that tight (i.e. expensive) tolerancing and concentricity are not necessary since the elastomer will allow the fuser tube 10 to deflect along its axis.

Excellent uniformity of fixing of toner material to copy paper has been achieved using a roller comprising a tube having a 3/16 inch thickness and an outer diameter of 2⅛ inches and a shaft having a one inch diameter, the balance of the roller consisting of a urethane elastomer. In general, the outer diameter of the tube should be about twice the diameter of the shaft, and the thickness of tube should be between about ⅛ and ¼ inch.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. Fusing apparatus for fixing toner material to a copy sheet, comprising:

a pair of parallel, cold pressure fixing rollers, each of said rollers consisting of a cylindrical rigid metal tube open at both ends thereof, a cured elastomer occupying the volume enclosed by and bonded to said cylindrical tube, and a shaft extending through and bonded to said elastomer, said shaft being concentric with said tube; and means for applying a force to one of the two roller shafts to thereby apply a uniform pressure to the nip of the cold pressure fixing rollers.

2. The apparatus of claim 1, wherein the elastomer comprises urethane.

3. The apparatus of claim 1, wherein the force applying means comprises a pair of bolts which apply a force on the ends of said one roller shaft in a direction perpendicular to the axis of the shaft.

4. The apparatus of claim 3, wherein the outer diameter of the tube is about twice the diameter of the shaft.

5. The apparatus of claim 4, wherein the thickness of the tube is between about ⅛ and ¼ inch.

* * * * *